US007377720B2

(12) United States Patent
Stewart

(10) Patent No.: US 7,377,720 B2
(45) Date of Patent: May 27, 2008

(54) BOAT LIFT

(75) Inventor: Luther Shane Stewart, Nokomis, FL (US)

(73) Assignee: Martin E. Romansi, Venice, FL (US)

( * ) Notice: Subject to any disclaimer, the term of this patent is extended or adjusted under 35 U.S.C. 154(b) by 464 days.

(21) Appl. No.: 11/206,583

(22) Filed: Aug. 18, 2005

(65) Prior Publication Data

US 2007/0041788 A1 Feb. 22, 2007

(51) Int. Cl.
*B63C 7/00* (2006.01)

(52) U.S. Cl. ..... 405/3; 114/44; 114/48

(58) Field of Classification Search ..... 405/1, 405/3; 114/44, 48, 50
See application file for complete search history.

(56) References Cited

U.S. PATENT DOCUMENTS

| | | | | |
|---|---|---|---|---|
| 3,675,258 | A | 7/1972 | Osmundson | 9/34 |
| 4,641,996 | A | 2/1987 | Seal | 405/2 |
| 6,598,549 | B1 | 7/2003 | Voegeli | 114/44 |

*Primary Examiner*—Tara L. Mayo
(74) *Attorney, Agent, or Firm*—Gifford, Krass, Sprinkle, Anderson & Citkowski, P.C.

(57) ABSTRACT

A boat lift supported completely from land adjacent to water in which a boat is to be operated for movement between storage and launching positions by the use of parallelogram linkage powered by pairs of hydraulic actuators arranged at opposite sides of the boat lift. A walk and handrails are formed between the hydraulic actuators for use by passengers boarding the boat in the boat launch position.

20 Claims, 2 Drawing Sheets

BOAT LIFT

FIELD OF THE INVENTION

This invention relates to boat lifts and more particularly to a boat lift that is mounted on land adjacent to the water for lowering a boat from a storage position on land to a launching position in the water.

BACKGROUND OF THE INVENTION

Boat lifts of various kinds have been developed but most are limited in one way or another because they rely on supporting underwater structures for installation and require special permits because they occupy submerged land owned by other than the riparian owner.

One structure which avoids many of these problems is disclosed in the patent to Voegeli U.S. Pat. No. 6,598,549 issued Jul. 29, 2003. In that patent the boat lift is supported from land adjacent to the water such as a bulkhead or seawall without relying on any underwater support. The Voegeli boat lift has many advantages but is limited to smaller boats because of the maximum weight of the boats that can be handled. This limitation is believed to result from the arrangement of hydraulic actuators which are disposed so that one actuator expands and the other simultaneously contracts between adjacent points on a parallelogram linkage and more widely spaced points on the land supported base structure.

SUMMARY OF THE INVENTION

It is an object of the invention to provide a boat lift which can be supported on dry land adjacent to the water and which moves a boat through a parallelogram linkage between a boat storage position on dry land and a boat launching position in which a boat is delivered to the water adjacent to the boat lift.

It is another object of the invention to provide a hydraulic system for such boat lifts in which the forces needed to move the boat are transmitted efficiently.

It is still another object of the invention to provide a boat lift having a hydraulic system in which the cylinders at each side of the boat lift are operated from a fully extended boat launching position to a collapsed or retracted boat storage position.

It is a further object of the invention to provide a boat lift having a hydraulic system in which pairs of cylinders are operated at the same time without any particular effort to make them operate in sequence or in a timed relationship to each other.

Yet another object of the invention is to provide a boat lift in which cylinders can be arranged at opposite sides of the boat lift to provide for the passage of users to the launched boat.

The objects of the invention are attained by a boat lift having a base member secured on land and a boat supporting structure connected to the base member by a lift frame having opposite ends pivotally connected to the base member and to the boat supporting frame at a pair of first pivot axes and a pair of tie bars having a length equal to the lift frame are connected at their opposite ends to the base member and supporting frame of a pair of second pivot axes. The first and second pivot axes are equally spaced to form a pair of parallelogram linkages with one at each side of the base member for guided movement of the boat supporting structure between a boat launching position and a boat storage position. Movement of these parallelogram linkages are attained simultaneously by a pair of support arms pivotally connected and extending upwardly at opposite sides of the base member with a first pair of fluid pressure actuators with one disposed at each side of the base member and acting between the support arm and base member and a second pair of fluid pressure actuators with one disposed at each side of the base member and operative to act between said support arm and the parallelogram linkage. The first and second pairs of fluid pressure actuators are operative to move the boat supporting platform between a boat launching position in which all of said actuators are fully extended and a boat storage position in which all of said actuators are fully retracted.

DETAILED DESCRIPTION

Figure 1:
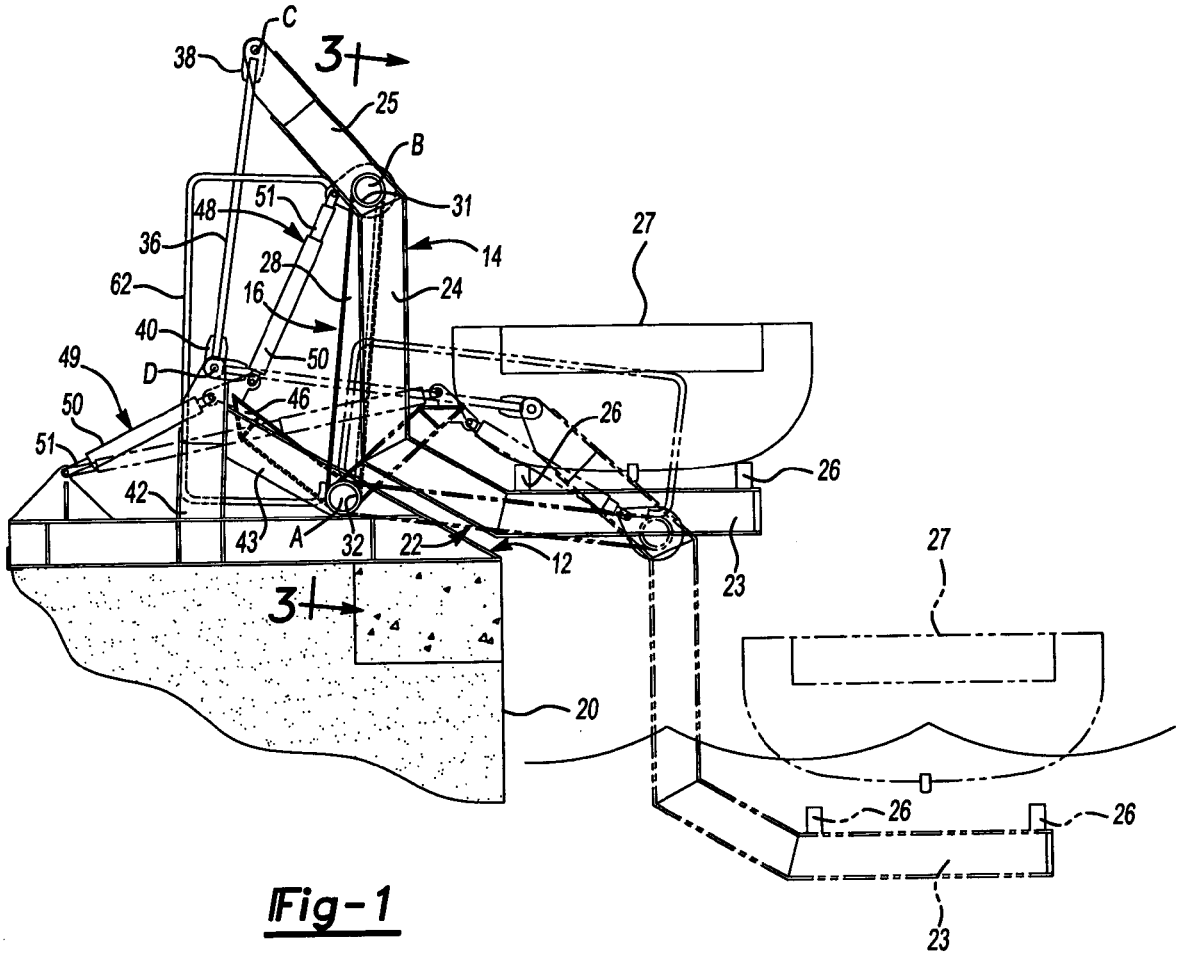
FIG. 1 is a side elevation of the boat lift embodying the invention illustrating a boat storage position in full line and a launch position in phantom line.

The boat lift embodying the invention is designated generally at 10 with its major components comprising a base 12 which is supported on land and a main frame 14 which supports a boat during the lifting operation and a lift frame 16 between the main frame and the base 12. The base 12 has a pair of rails 17 to be fixed to a foundation or pad 18 adjacent to the shore or seawall 20 (as seen in FIG. 1) separating the land from the water at the shore of a body of water.

The main frame 14 is fabricated of steel I-beams and has a pair of side members 22, each which has a horizontal portion 23, a vertical portion 24 and an angled upper arm 25. The main frame side members 22 are spaced apart the same as the side rails 17 of base 12. The horizontal portions 23 of main frame 14 can be fitted with wooden stringers 26 to engage opposite sides of a bottom of a boat 27 to support it during lifting operations. Such stringers 26 are custom made to fit the boat bottom to be handled.

The lift frame 16 is generally rectilinear with a pair of side members 28 of steel I-beams and a pair of transverse tubular pivot members 29 and 30 at opposite ends of the side members 28. The pivot members project outwardly from opposite sides of the side members 28 to form bearing support for other components of the lift 10 such as the base member 12 and main frame 14. As seen in FIG. 1, the outer ends of the tube 29 are journaled in bearing members 31 fixed near the juncture of vertical member 24 and upper arm 25 in each of the side members 22. The outer ends of lower tube 30 are journaled in bearing members 32 fixed in a similar manner at opposite sides of base member 12.

A pair of tie bars 36 are disposed parallel to side members 28 of lift frame 16. One end of each of the two tie bars 36 are connected at pivot elements 38 to the outer ends of upper arms 25 of lift frame 16 and the other ends of tie bars 36 are each connected at pivot elements 40 to the upper ends of vertical members 42 extending upwardly from the side rails 17 of base 16. A pair of braces 43 extend from side rails 17 of base 12 to vertical members 42 and the bearing members 32 are supported in the braces 43.

The various components form four corners of a parallelogram linkage. A first pivot axis A is formed at the axis of tube 30 between base 12 and lift frame 16 and a second pivot axis B is formed at the axis B tube 29 between main frame 14 and lift frame 16. Similarly, the pivot connections 38 at one end of tie bar 36 at main frame 14 forms a third pivot axis at C and the pivot connection 40 at base 12 forms a fourth pivot axis at D. The distance between pivot axes A and B are equal to the distance between pivot axes C and D to form the long side of the parallelogram linkage. Similarly, the pivot axes A and D and pivot action B and C are equal spaced to form the short sides of a rectangular parallelogram linkage.

Figure 3:
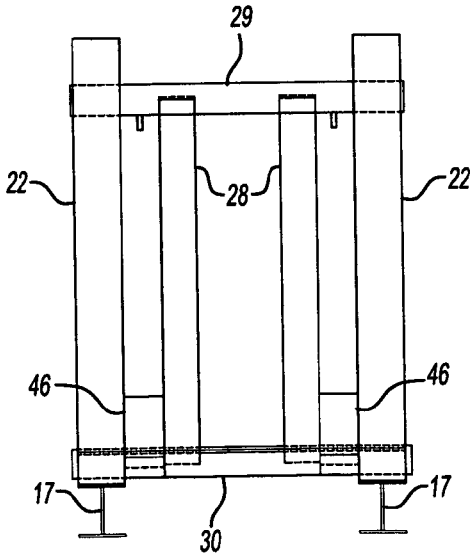
FIG. 3 is an end elevation taken on line 3-3 FIG. 1.

The parallelogram linkage serves to move the base supporting horizontal member 23 of the main frame 14 and to maintain it in its horizontal position during all of its movement between a boat storage position as seen in full lines in FIG. 1 and a boat launching position as seen in FIG. 3. From an examination of FIG. 1 it will be seen that the parallelogram linkage is tilted from the horizontal so that the upper arm 25 of main frame 14 between pivot axis A and B moves in an arc between a boat storage and launch positions with the horizontal portion 23 of the main frame 14 moving away from the base member 12 and downwardly toward the water.

The hydraulically powered means for moving the parallelogram includes a pair of upwardly extending load transfer arms 46 having their lower end pivoted to tube 30 at a point between braces 43 of base 12 and the lift frame 16. The upper ends of transfer arms 46 are provided with a connector 47 forming the mounting for pivotal connection to a pair of double acting hydraulic actuator cylinders 48 and 49 each having a cylinder end 50 and a rod end 51. As seen in FIG. 1, the cylinder end 50 of each of the hydraulic cylinders 48 and 49 is connected to the connector 47. The rod end 51 of hydraulic cylinder 49 is connected to a mounting member on the base frame 12 and the rod end 51 of cylinder 48 is connected to a pivot member fastened to tube 31 at the pivot axis B. The arm 46 and cylinders 48 and 49 are duplicated at opposite sides of the lift structure 10.

Figure 2:
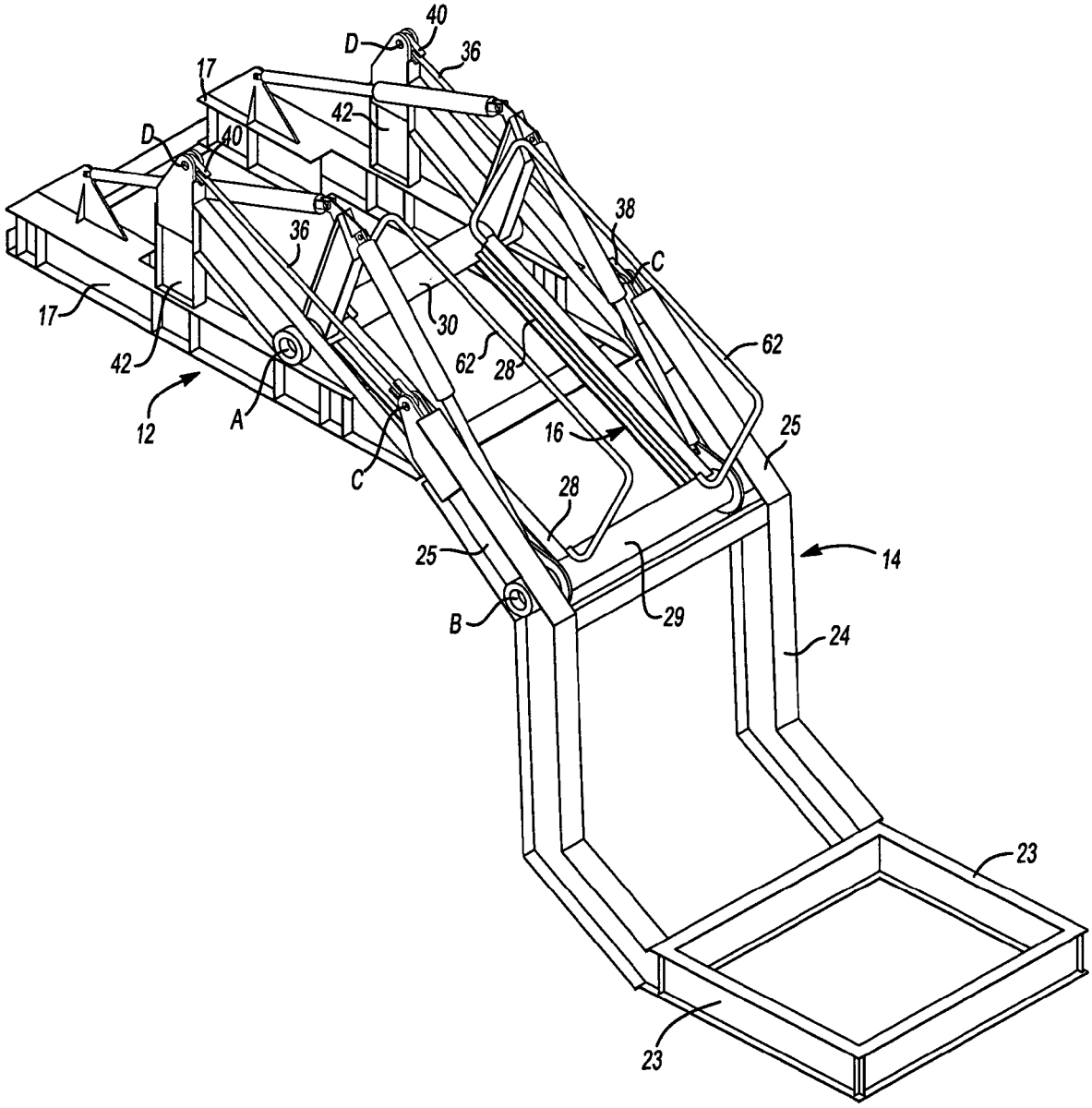
FIG. 2 is a perspective view of the boat lift apparatus in its boat launching position in which the boat supporting platform would be submerged in water.

Upon transmission of hydraulic fluid simultaneously to all four cylinders when the main frame 14 is in its boat storage position as seen in FIG. 1 and with all of the cylinders initially collapsed, the extension of rods 50, 51 of the hydraulic actuators 48 and 49 causes the parallelogram to move the main frame 14 until the horizontal member 23 is submerged in the water in its boat launching position as seen in phantom line in FIG. 1 and in FIG. 2.

To move the lift in a return direction to a boat storage position the hydraulic actuators are operated to retract from their fully extended position to a fully collapsed or retracted condition as seen in full line in FIG. 1. In that position the angled portion of the lift frame 16 between the horizontal portion 23 and vertical portion comes into abutting relation with a complementary top surface of the base 12 as seen in FIG. 1 so that the lifting mechanism and the boat on the platform 23 are relieved of the loads experienced during movement to and from the boat launch position seen in FIG. 3.

The boatlift 10 is provided with a gang plank or walk which is disposed between hand rails 62 at opposite sides and is disposed centrally of the boatlift 10 between the mechanism at opposite sides. The walk and hand rails 62 are mounted on the transverse mounting tubes 29 and 30 at opposite ends of the lift frame 16 and moves therewith so that it is accessible for use when the boatlift 10 is in its boat launching position as seen in FIG. 3. In the boat storage position seen in FIG. 1 the walk and hand rails 62 are disposed vertically.

The hydraulic controls and the various hydraulic lines are not shown but can be mounted in selected locations, for example, to one side of the lift 10 where operation of a single lever controlled valve gives the operator the control and good visibility of the boat launching and boat storage operations.

The invention claimed is:

1. A boat lift comprising:

a base member adapted to be secured to land adjacent to the water;

a boat supporting frame having a boat supporting platform with a forward portion adjacent to the water and a rear portion spaced from the water;

a lift frame having opposite ends pivotally connected to said base member at a first axis and to said boat supporting frame at a second axis;

a tie bar having a length substantially equal to said lift frame with one end connected to said base member at a third axis and the other end connected to said lift frame at a fourth axis, said four axes forming the corners of a parallelogram linkage for guided movement of said boat supporting frame relative to said base member between a boat launching position in which said platform is submerged in the water and a boat storage position in which said platform is above water and adjacent to said base member;

a support arm pivoted to said base member and extending upwardly; and first and second fluid pressure actuators each having a cylinder end and an extendable rod end, said first fluid pressure actuator having one of its said ends connected to said base member and the other of its said ends connected to said support arm, said second fluid pressure actuator having one of its said ends connected to said support arm and the other of its said ends to said lift frame to move said parallelogram linkage and said platform between said boat launching position in which both of said actuators are fully extended and a boat storage position adjacent to said base member in which both of said actuators are collapsed.

2. The boat lift of claim 1 wherein said support arm has one end pivotally connected to said base member and to said lift frame at said first axis.

3. The boat lift of claim 1 wherein said support arm moves toward said rear portion of said base member during movement of said lift frame toward said storage position and moves toward said front portion of said base member during movement of said lift frame to said boat launching position.

4. The boat lift of claim 1 wherein the upper end of said support arm moves toward said front portion of said base member during movement of said boat supporting frame from its boat storage to the boat launching positions.

5. The boat lift of claim 1 wherein said second fluid pressure actuator is connected to said boat supporting frame and to said lift frame at said second axis.

6. The boat lift of claim 1 wherein said first fluid pressure actuator is connected adjacent to a rear portion of said base member.

7. The boat lift of claim 1 wherein said first and fourth axis of said parallelogram linkage are closer together in said boat launch position than in said boat storage position.

8. The boat lift of claim 1 wherein said tie bar support arm and first and second fluid pressure actuators form a first set of power transmitting members disposed at one side of said base member, and a second set of power transmitting members is disposed at the other side of said base member to act simultaneously and identically during movement of said main frame between said boat launching and storage positions.

9. The boatlift of claim 8 having hand rails and a walk platform disposed between said first and second sets of power transmitting members to give passengers access to a boat in the boat launching position of said boat lift.

10. The boatlift of claim 9 wherein said boat supporting frame has a portion resting on said base member in said boat storage position.

11. A boat lift comprising:

a base member adapted to be secured to land adjacent to the water;

a boat supporting frame having a boat-supporting platform;

a lift frame having opposite ends pivotally connected to said base member and said boat supporting frame at a first pivot axis;

a pair of tie bars each having a length substantially equal to said lift frame and each having opposite ends connected to said base member and boat supporting frame at said second pivot axis at opposite sides of said main frame, said second pivot axis being spaced equally from said first pivot axis, said lift frame, said tie bars and said spaced first and second pivot axes forming a parallelogram linkage at each side of said base member for guided movement of said lift frame relative to said base member between a boat launching position in which said platform is spaced from said base member and is submerged and a boat storage position above water and adjacent to said base member;

a pair of support arms pivoted to said base member and extending upwardly at opposite sides of said base member;

a first pair of fluid pressure actuators disposed with one at each side of said base member and each operative to act between one of said support arms and said base member; and a second pair of fluid pressure actuators disposed with one at each side of said base member and operative to act between said support arm and said parallelogram linkage, said first and second pairs of fluid pressure actuators being extendable and operative to move said platform between said boat launching position in which all of said actuators are fully extended to said boat storage position in which all of said actuators are retracted.

12. The boat lift of claim 11 wherein said support arms are pivoted to said base member for pivotal movement along said first pivot axis between said lift frame and said base member.

13. The boat lift of claim 12 wherein the upper ends of said pair of support arms move toward the rear of said base member during movement of said lift frame toward said storage position and move towards the forward portion of said base member during movement of said lift frame to said boat launching position.

14. The boat lift of claim 12 where the upper ends of said support arm move fowardly relative to said base member during movement of said boat supporting frame from its said boat storage to boat launching positions.

15. The boatlift of claim 11 wherein said lift frame and said tie bars are disposed substantially vertically in said boat storage position.

16. The boatlift of claim 11 wherein said boat supporting frame has a portion resting on said base member in said boat storage position.

17. A boat lift comprising:

a base member adapted to be secured to land adjacent water;

a boat supporting frame having a boat engaging platform;

a lift frame having opposite ends pivotally connected to said base member at a first pivot axis and to said boat supporting frame at a second pivot axis;

a tie bar having a length substantially equal to said lift frame with opposite ends connected to said base member and to said boat supporting frame at third and fourth pivot axes spaced equally from said first and second pivot axes, said lift frame, tie bar and spaced first, second, third and fourth pivot axes forming a parallelogram linkage for guided movement of said lift frame relative to said base member between a boat launching position in which said platform is submerged and a boat storage position in which said platform is above water and adjacent to said base member;

a support arm pivoted to said base member and extending upwardly; and first and second fluid pressure actuators each having a cylinder end and an extendable rod end, said first fluid actuator having its said ends connected to said base member and to said support arm, said second fluid pressure actuator having its said ends connected to said support arm and to said boat supporting frame to move said parallelogram linkage and said platform between said boat launching position in which both of said actuators are fully extended and said boat storage position in which both of said actuators are collapsed.

18. The boat lift of claim 17 wherein said actuators are operated simultaneously during movement of said platform between said boat launching and storage positions.

19. The boat lift of claim 17 wherein said lift frame is disposed substantially vertically when said boat platform is in the boat storage position.

20. The boat lift of claim 17 wherein said main frame is in abutting load support relation to said base member when said platform is in the boat storage position.

* * * * *